United States Patent [19]

Nakayama et al.

[11] 4,275,092

[45] Jun. 23, 1981

[54] METHOD FOR PRODUCING A PLATE OR SHEET USEFUL IN PLANOGRAPHIC PRINTING

[75] Inventors: Hiroyuki Nakayama; Akira Kato; Masuo Tsuchiya, all of Hiratsuka, Japan

[73] Assignee: Kansai Paint Co., Ltd., Japan

[21] Appl. No.: 39,308

[22] Filed: May 15, 1979

Related U.S. Application Data

[63] Continuation of Ser. No. 819,768, Jul. 28, 1977, abandoned.

[30] Foreign Application Priority Data

| | | | |
|---|---|---|---|
| Jul. 30, 1976 | [JP] | Japan | 51-91464 |
| Jun. 14, 1977 | [JP] | Japan | 52-70197 |
| Jun. 14, 1977 | [JP] | Japan | 52-70198 |

[51] Int. Cl.[3] ..... B05D 3/06

[52] U.S. Cl. ..... 427/54.1; 101/463.1; 430/296; 430/297; 430/302

[58] Field of Search ..... 427/54, 44, 53; 96/33; 101/463, 465, 466, 467

[56] References Cited

U.S. PATENT DOCUMENTS

| | | | |
|---|---|---|---|
| 3,263,604 | 8/1966 | Dalton | 101/467 |
| 3,488,215 | 1/1970 | Sheperd et al. | 428/441 |
| 3,566,874 | 3/1971 | Shepherd et al. | 427/54 |
| 3,745,042 | 7/1973 | Lim et al. | 427/384 |
| 3,892,575 | 7/1975 | Watts et al. | 427/54 |
| 4,054,094 | 10/1977 | Caddell et al. | 101/467 |

FOREIGN PATENT DOCUMENTS

| | | | |
|---|---|---|---|
| 1496152 | 7/1973 | Fed. Rep. of Germany | 101/469 |
| 2450535 | 4/1976 | Fed. Rep. of Germany | 101/467 |
| 5073703 | 6/1975 | Japan | 101/467 |

*Primary Examiner*—John H. Newsome

*Attorney, Agent, or Firm*—Ostrolenk, Faber, Gerb & Soffen

[57] ABSTRACT

A method for producing a plate or sheet useful in planographic printing which comprises providing a substrate of an oleophilic resin having in the molecules thereof carbon-carbon double bonds and/or carbon atoms bonded with a single hydrogen atom in a total amount of not less than 0.05 mol/kg, contacting the substrate with a hydrophilic radical polymerizable compound and exposing the substrate contacted with the compound to actinic way to form a plate having a hydrophilic thin layer chemically combined with the substrate. The substrate may be mixed with conductive or semiconductive powder uniformly dispersed in the oleophilic resin so as to have a volume resistivity in the range of from $10^{-3}$ to $10^{8}$ ohm.cm. In doing so, an electrical printing plate making method which is very advantageous in easiness and usefulness is applicable to the plate or sheet for planographic printing according to the invention.

12 Claims, No Drawings

METHOD FOR PRODUCING A PLATE OR SHEET USEFUL IN PLANOGRAPHIC PRINTING

This is a continuation of application Ser. No. 819,768, filed July 28, 1977 now abandoned.

FIELD OF THE INVENTION

This invention relates to a method for producing a plate or sheet useful in planographic printing.

BACKGROUND OF THE INVENTION

In the art of planographic printing, it is the common practice to use a metal plate to which is imparted on one surface thereof water retentivity or a hydrophilic property by a graining or anodizing method and then coated an olephilic photosensitive composition. However, the prior metal plate for printing involves a number of disadvantages. One of the disadvantages is that the manufacturing process is complicate and thus the plate is expensive in production. Another disadvantage is that the making of a printing plate essentially requires relatively difficult, delicate steps such as a lithographic film-making step, a developing step, etc., presenting difficulties in planographic printing.

In order to overcome the above disadvantages, there have been proposed several plates for planographic printing or methods for easily making such plates which are usable in plate making directly from an electrical signal converted from an intended image. Such a plate is disclosed, for example, in Japanese laid-open Patent Application No. 124708/1975, in which an oleophilic substrate principally made of an oleophilic resin is subjected to corona discharge to form a hydrophilic layer on one surface of the substrate. For example, the printing plate making can be done directly by selectively destroying or removing areas of the hydrophilic layer corresponding to an intended image by a mechanical, thermal or electrical method. The plate for planographic printing of the type just mentioned has various advantages such as easy printing plate making, good reproducibility of image and the like. However, the printing plate suffers from objectionable disadvantages mainly due to lack of hydrophilic property of the hydrophilic layer formed on one surface of the substrate by corona discharge: the printing plate has a low durability of, for example, less than several thousands prints and there is a relatively severe limitation in the kind of ink employable.

SUMMARY OF THE INVENTION

It is therefore an object of the present invention to provide a method for producing a plate or sheet useful in planographic printing which overcomes the above-mentioned prior disadvantages and which is excellent in reproducibility of image and durability.

It is another object of the present invention to provide a method for producing a plate or sheet useful in planographic printing which has a satisfactory affinity for the ordinarily employed planographic printing inks.

It is a further object of the present invention to provide a method for producing a plate or sheet useful in planographic printing from which a printing plate can be readily made by any of the mechanical, thermal and electrical methods.

It is a still further object of the present invention to provide a method for producing a plate or sheet useful in phanographic printing which is suitable for making a printing plate by an electrical method such as a facsimile system.

It is another object of the present invention to provide a method for producing a plate or sheet useful in planographic printing which is relatively inexpensive in production and easy to make.

According to the present invention, there is provided a method for producing a plate or sheet useful in planographic printing which comprises providing a substrate of an oleophilic resin having in the molecules thereof carbon-carbon double bonds and/or carbon atoms bonded with a single hydrogen atom in a total amount of not less than 0.05 mol/kg contacting the substrate with a hydrophilic radical polymerizable compound, and exposing the substrate contacted with the compound to actinic ray thereby forming a hydrophilic thin layer chemically combined with the substrate. The substrate may have conductive or semiconductive powder uniformly dispersed in the oleophilic rsdin so as to have a volume resistivity in the range of from $10^{-3}$ to $10^{8}$ ohm.cm. In doing so, an electrical printing plate making method which is very advantageous in easiness and usefulness is applicable to the plate or sheet useful in planographic printing according to the invention. The substrate may be supported by a paper, plastic or metal sheet. The exposure is conducted by using an actinic ray having a wavelength range of 250 nm to 700 nm within which a proper wavelength is selected depending on the kind of the polymerizable compound. The hydrophilic radical polymerizable compound may be in the form of a composition which comprises up to 10% by weight of a photosensitizer, up to 50% by weight of other radical polymerizable compound for controlling the hydrophilic property, and up to 90% by weight of a solvent for improving affinity for the oleophilic substrate. It should be noted, however, that the composition must contain at least 4% by weight of the hydrophilic radical polymerizable compound to form the hydrophilic thin layer on the substrate in a satisfactory manner. The hydrophilic thin layer is formed from the hydrophilic radical polymerizable compound by actinic ray irradiation and is thus made of the compound per se and a polymer thereof.

DETAILED DESCRIPTION OF THE INVENTION

The oleophilic resins useful in the present invention must be those which have satisfactory affinity for various kinds of planographic printing ink and which permits chemical combination with a hydrophilic radical polymerizable compound upon exposure to actinic ray. Examples of the resins include: polymers having in the molecules thereof carbon-carbon double bonds and polymers having in the molecules thereof carbon atoms bonded with a single hydrogen atom.

Examples of the former include: diene homopolymer such as polybutadiene, polyisoprene, polypentadiene and the like; diene copolymer of diene monomers such as butadiene, isoprene, pentadiene, etc., with monomers other than the diene monomers such as styrene, acrylic acid esters, methacrylic acid esters, acrylonitrile, methacrylonitrile, etc; unsaturated polyesters; unsaturated polyepoxides; unsaturated polyamides; and unsaturated polyacryls;

Examples of the latter include: high density polyethylene; homo-or copolymers of 1-substituted olefins such as styrene, propylene, vinyl chloride, acrylonitrile, acrylic acid, acrylic acid esters, alkylvinyl esters, vinylcarbazole, etc.; copolymers of the above-mentioned 1-substituted olefins with 1,2-di-substituted olefins such as maleic acid, fumaric acid, crotonic acid, etc.; copolymers of the above-mentioned 1-substituted olefins and/or the above-mentioned 1,2-di-substituted olefins with 1,1-di-substituted olefins such as methacrylic acid, methacrylic acid esters, methacrylonitrile, isobutene, etc.; epoxy resins such as condensation products of hydrogenated or non-hydrogenated bisphenols and epichlorohydrin; phenolic resins etherized with glycidyl ether, etc.; phenolic resins such as condensation products of phenols including hydrocarbon radical-substituted phenol with formaldehyde; polyesters; polyurethanes; polyamides; amino resins such as melamine-formaldehyde resin and guanamine-formaldehyde resin; polycarbonates; polyethers; furan resins; polysulfons; polyimides; etc. Of the above mentioned resin, polymers having in the molecules thereof carbon atoms bonded with a single hydrogen atom are particularly preferred. These oleophilic resins may be used singly or in combination of two or more. As described hereinbefore, the resins must have in the molecules thereof carbon-carbon double bonds and/or carbon atoms bonded with a single hydrogen atom in a total amount of not less than 0.05 mol/kg, preferably not less than 0.1 mol/kg. An amount less than 0.05 mol/kg will cause insufficient chemical combination with a hydrophilic radical polymerizable compound by actinic ray irradiation, resulting in impartment of unsatisfactory hydrophilic property to the surface of polymer substrate. The above mentioned oleophilic resins have a contact angle of above 40 degrees with pure water when determined at a ordinary temperature. In practice, it is preferred that the resin having a contact angle of above 50 degrees with pure water is used. In other words, when the flat surface of a resin substrate is contacted with pure water to form a continuous water film thereon and the water-bearing surface is vertically held, the substrate has preferably such a high contact angle as not to ensure the stability of the water film. Substrates of resin having lower degree of oleophilic property than the above-mentioned case are difficult to use as a plate or sheet for planographic printing of the present invention.

The polymers suitable for making oleophilic substrates according to the invention have been described. As a matter of course, these polymers may have added such additives such as curing agent, plasticizer, stabilizer, surface active agent, coloring agent, conductive agent, filler, and the like. If these polymers can not hold a fixed form when shaped at a room temperature or are not satisfactory in mechanical or physical properties, they may be treated by suitable methods such as heating, ensuring the fixed form or improvement of the properties. In order to provide a substrate by use of the polymers, the polymer is generally applied onto a support such as paper, plastics, metals or the like, in the form of a solution, a dispersion, a melt or the like. Alternatively, the polymer may be molded into a suitable form such as film, sheet, plate, cylinder, tube, lamp or the like. In most cases, the substrate is shaped in the form of a sheet. The polymer layer is generally in the range of from 5 to 300 μm, preferably 8 to 40 μm in thickness when produced on a support by spraying and the thickness of the polymer substrate is from 50 to 200 μm when formed by molding of the polymer without use of support. Needless to say, the sheet which has been formed without use of any support may be laminated with a suitable support in a subsequent stage. On the contrary, if the support is used, it may be removed after formation of the film or sheet of substrate.

The substrate is then provided with a hydrophilic thin layer chemically combined with the surface thereof. The hydrophilic layer is made of a hydrophilic radical polymerizable compound or its polymer. Formation of the layer is as follows: the polymerizable compound is first contacted with the surface of the substrate and the contacted surface is exposed to actinic ray to induce a radical polymerization, causing chemical combination of the compound with the surface of the substrate. Also, the contacted surface may be heated at above 50° C., preferably above 80° C., for about one minute to 10 hours to induce a radical polymerization. The hydrophilic compounds should be radical polymerizable. Otherwise, the substrate surface is not formed with a continuous hydrophilic layer and is thus not imparted with the hydrophilic property in a satisfactory manner. The hydrophilic compounds usable in the present invention are desired to be so radical polymerizable that when a photosensitizer coexists in the reaction system, they begin to undergo an addition polymerization reaction by an actinic ray irradiation using a wavelength being absorbed by the compounds. Further, the hydrophilic compounds must have a nature that the homopolymers derived therefrom are dissolved in water or hydrophilic organic solvents or swollen by absorbing water or the organic solvents in an amount greater than 10% by weight at room temperature. Examples of such hydrophilic organic solvents are alcohols such as methyl alcohol, isopropyl alcohol, isobutyl alcohol, etc., ketones such as acetone, methyl ethyl ketone, methyl isobutyl ketone, etc., cyclic ethers such as dioxane, tetrahydrofuran, etc., ethylene glycol ethers such as ethylene glycol monoethyl ether, etc. Moreover, it is necessary that the hydrophilic compounds do not dissolve or attack the oleophilic polymer substrate to a considerable extent. Usable hydrophilic compounds may have a wide range of molecular weights and may thus be polymers. Examples of the hydrophilic compounds useful in the present invention include: acrylic and methacrylic acid; acrylic and methacrylic esters such as 2-hydroxyethyl acrylate, 2-hydroxyethyl methacrylate, diethylene glycol monoacrylate, diethylene glycol monomethacrylate, triethylene glycol monoacrylate, triethylene glycol monomethacrylate, 2-hydroxypropyl acrylate, 2-hydroxypropyl methacrylate, 3-hydroxypropyl acrylate, 3-hydroxypropyl methacrylate, glycerol monoacrylate, glycerol monomethacrylate, polyethylene glycol monoacrylate, polyethylene glycol monomethacrylate, polyethylene glycol diacrylate, polyethylene glycol dimethacrylate (a number average molecular weight of the polyethylene glycol moiety of at least 300) 2-dimethylaminoethylacrylate, 2-dimethylaminoethylmethacrylate, 2-dimethylaminoacrylate, 2-dimethylaminomethacrylate, 2-sulfoethylacrylate, 2-sulfoethylmethacrylate, 3-sulfopropylacrylate, 3-sulfopropylmethacrylate, 2-phosphoric ethyl acrylate, 2-phosphoric ethyl methacrylate, 2-phosphoric-1-chloromethylethyl acrylate, 2-phosphoric-1-chloromethylethyl methacrylate, etc; vinyl compounds having a nitrogen-containing heterocyclic ring such as N-vinylimidazole, acryloyl morpholine, vinylpyridine, N-vinylpiperidone, N-vinylcarprolactam, N-vinylpyrolidone, N-vinylmorpholine, etc; styrene sulfonic acids such as p-styrene sulfonic acid; maleic acids such as maleic acid and its anhydride, phenylmaleic acid and an anhydride thereof, methylmaleic acid and an anhydride thereof; maleimides such as maleimide, methylmaleimide, phenylmaleimide, etc; acrylic and methacrylic amides such as acrylic amide, methacrylic amide, N-methylacrylic amide, N-methylmethacrylic amide, N-ethylacrylic amide, N-ethylmethacrylic amide, N-propylacrylic amide, N-propylmethacrylic amide, N-butylacrylic amide, N-butylmethacrylic N-2-hydroxyethylacrylic amide, N-2-hydroxymethacrylic amide, N,N-methylenebisacrylic amide, N,N-methylenebismethacrylic amide, N-methylolacrylic amide, N-methylolmethacrylic amide, acrylic morphorine, methacrylic morphorine, N-propyloxyacrylic amide, N-propyloxymethacrylic amide, N,N-dimethylacrylic amide, N,N-dimethylmethacrylic amide, N,N-diethylacrylic amide, N,N-diethylmethacrylic amide, diacetoneacrylic amide; polyvinyl alcohol condensed with N-methylolacrylic amide; acrylic resin containing hydroxyl groups addition reacted with maleic anhydride; and mixture thereof. Of these compounds vinyl compounds having a nitrogen-containing heterocyclic ring and acrylic and methacrylic amides are particularly preferable because of their excellent reactivity with the substrate.

These compounds may be used singly or in combination of two or more and also may be in the form of a composition mixed with ordinarily employed hydrophobic radical polymerizable compounds such as styrene, vinyltoluene, etc., volatile organic solvents and thickners. In this connection, it should be noted that the hydrophilic compounds must be contained in the composition in an amount of at least 4%, preferably 15% or more, by weight of the composition. The hydrophobic radical polymerizable compounds serve to control the hydrophilic property and the degree of copolymerization of the hydrophilic compounds and are generally used in used in amounts of less than 50% by weight of the composition. The volatile organic solvents are, for example, alcohols, esters, ketones, ethers and aromatic solvent by which a uniform contact of the hydrophilic compound with an oleophilic substrate is facilitated. These organic solvents are generally used in amounts of less than 90% by weight of the composition. The usable thickeners are water-soluble polymers such as cellulose derivatives and are employed in amount of less than 20% by weight of the composition. Once again, the hydrophilic compounds should be used in amounts of at least 4% and otherwise the hydrophilic surface layer will not be formed satisfactorily.

To the hydrophilic compounds or compositions thereof may be further added additives such as amine compounds such as alkanol amines, hydrophilic surface active agents (having HLB value of, for example, above 10) so as to produce an increased hydrophilic effect.

Moreover, the hydrophilic compounds or compositions thereof are generally mixed with photosensitizers in order to reduce a time generally required for the actinic ray irradiation. The photosensitizers useful in the present invention are those which have a triplet state energy of above 50 kcal/mol or which are capable of producing free radicals by actinic ray. There are used known photosensitizers including, for example, substances capable of producing free radicals by actinic ray irradiation by itself, such as benzoin ethers, azobisisobutyronitrile, thiuram compounds and the like, substances capable of producing free radicals by withdrawal of active hydrogen or other molecules, such as benzophenone, acetophenone, and the like, photo-redox system such as ferric chloride, Michler's ketone, and dye-reduction system such as a combination of riboflavin and ascorbic acid.

The hydrophilic compound or composition can be contacted to the oleophilic polymer substrate by any of known methods. For example, when the compound or composition is liquid, the substrate is coated with or immersed in the liquid. When the compound is a solid of low melting point, it is melted or a molten compound is flow down on the substrate surface. In addition, with those compounds being ready to vaporize, the vapor may be contacted with the substrate. If the compound is formed on the substrate surface in such a thick layer that there is a possibility of lowering the efficiency of ray irradiation, it is desireable to remove an excessive portion by wiping away or evaporation.

It will be noted here that the hydrophilic compound or composition should be properly used so as not to dissolve the oleophilic substrate. That is, in the non-mixing contact surface between the polymer substrate in solid phase and the hydrophilic polymerizable compound in gaseous, liquid phase or solid phase, the energy transfer caused by actinic rays and the mass transfer of active sites are brought about to impart hydrophilic property to the polymer substrate, which is the characteristic feature of the present invention.

The actinic light to be employed for the irradiation should preferably be in a wavelength range of 250 nm to 700 nm and is desired not to involve any light rays of wavelength which given an adverse influence on polymer substrate. The light sources from which such actinic rays is emitted may be any of known ones such as low pressure mercury lamp, high pressure mercury lamp, fluorescent lamp, xenon lamp, carbon arc lamp, tungsten incandescent electric lamp, sunlight, and the like. The irradiation is feasible directly or thorought a ray permeable wall of vessels from the side of the hydrophilic compound layer or from the side of the substrate if it is ray-permeable or from the both sides.

The time required for the irradiation varies depending on the kind of the substrate polymer and the hydrophilic compound the degree of desired hydrophilic property and the type of the actinic ray source, and may generally be within a range of 0.1 second to 24 hours.

The substrate thus treated on the surface thereof is washed with a non-solvent the substrate such as water, alcohols, ketones, esters or the like to remove the unreacted compound and the polymer derived from the compound but not chemically combined with the substrate. The thus treated substrate may be further contacted with water or an aqueous electrolyte solution over a relatively long period of time but within a range not involving removal of the combined layer, thereby to improve the hydrophilic property of the layer. It is believed that the treatment for imparting hydrophilic property according to the invention makes use of the addition reaction of the hydrophilic compound with the polymer substrate based on a free radical polymerization mechanism and induced by absorption of ray energy. Proper selection of wavelength of actinic ray ensures satisfactory hydrophilic property without causing deterioration of the substrate per se. The substrate surface which is now rendered hydrophilic according to the present invention is considerably lowered in contact angle with pure water. Even if the surface is rubbed in boiled water, the hydrophilic property is not lost at all. The hydrophilic layer is generally formed in a thickness of several microns so as to facilitate a subsequent plate-making process and printing operations.

It is noted that the difference of contact angles with pure water at a room temperature between the oleophilic substrate and the hydrophilic layer formed on the substrate must be in the range of more than 20 degrees or more. Also, it is preferred that the hydrophilic layer has a contact angle of 20 degrees or less with pure water at a room temperature.

The method for producing a plate or sheet useful in planographic printing has been described hereinabove. The thus made plate or sheet can be readily applied as printing plate by removing or destroying the hydrophilic layer in an imagewise pattern by mechanical, thermal, electrical or other known methods. As well known, the mechanical and thermal methods are generally conducted by using laser beam, supersonic vibrator, thermal-pen, hard pen and the like. These means are suitably usable to make printing plates. Further, an electrical plate-making method using a facsimile system is known to be very useful because of a number of advantages including that the plate-making is very easy, a master plate can be directly made by means of an electrical signal converted from an intended image, and a master plate can be made even in remote places by transmission of electrical signal.

In order to make a printing plate by the electrical method, the oleophilic polymers constituting the substrate should have uniformly dispersed therein uniformly with conductive or semiconductive substances generally in the form of powder, as described hereinbefore. The substances useful for the purpose are carbonaceous materials such as carbon black, graphite, etc., metals such as copper, silver, stainless steel, etc., semiconductive metal compounds such as zinc oxide, titanium dioxide and the like compounds doped with impurity element such as aluminum. In practice, the substrate dispersing therein the conductive or semiconductive powder should have a volume resistivity of $10^{-3}$ to $10^{8}$ ohm·cm, preferably 10 to $10^{6}$ ohm·cm. To this end, the conductive or semiconductive powder is used in an amount of 5 to 800 parts by weight, preferably 5 to 50 parts by weight in case of carbonaceous materials or metal and 100 to 600 parts by weight in case of the semiconductive metal compound, per 100 parts by weight of the polymer.

The making of printing plate which has dispersed therein conductive or semiconductive power will be described. For example, a sheet for planographic printing is placed in a facsimile apparatus and contacted with a needle electrode for scanning. Upon the scanning, an applied voltage is varied according to an electrical signal corresponding to an image pattern, i.e., voltage is applied to area where image are to be formed, thereby selectively destroying the hydrophilic layer to give an imagewise pattern thereon.

To facilitate the electrical plate making, the sheet for planographic printing is preferred to include a support for carrying thereon the substrate. The support may be a film or sheet such as paper, plastic or metal. If the paper or plastic film or sheet is used, it is preferred that the plastic film or sheet is vacuum deposited or laminated with a metal such as aluminum to form a metal layer on one surface of the sheet. In addition, if no support is used to make a substrate film or sheet, the sheet should preferably be vacuum deposited with a metal in a subsequent stage to form a conductive layer on the surface facing the oleophilic side of the substrate thereby ensuring passage of electric current through the substrate upon making a printing plate by the electrical method.

The plate or sheet for planographic printing obtained according to the method of the invention is easy to make and has excellent printability such as reproducibility of image, durability, ink adaptability, etc. The printing plate obtained therefrom can yield prints of high resolving power due to high hydrophilic property.

The present invention will be particularly illustrated by way of the following examples, which should not be construed as limiting thereto the present invention.

EXAMPLE 1

100 g of 1,4-polybutadiene ("LCB-150", produced by Nippon Zeon Co., Ltd.) was dissolved in 500 g of mineral spirits, to which was added 40 g of conductive carbon black ("Corax L" product of Degussa Co., of West Germany), followed by dispersing in a paint conditioner. To the dispersion was added 0.1 g of cobalt naphthenate calculated as metallic cobalt to give a composition.

The composition was applied onto one surface of a 0.15 mm thick aluminum sheet in such a manner that a 10 μm thick film was obtained after drying. After removal of the solvent by evaporation, the foil was baked at 170° C. to 180° C. for 15 minutes to give a conductive oleophilic substrate A. The resulting polybutadiene layer had a volume resistivity of about $2\times10^{2}$ ohm·cm.

Substrate A was coated on the one side of the polybutadiene layer with a solution which consisted of 40 g of acrylamide, 2 g of benzophenone, 2 g of diethanolamine and 60 g of methanol. Thereafter, the acrylamide layer (about 2μ) on the substrate was irradiated with actinic ray at a distance of 5 cm from the layer for 5 minutes by use of a high pressure mercury plate of 200 W. The thus irradiated lamp was washed with water to obtain a plate A for planagraphic printing having a hydrophilic layer on one surface thereof.

The reproduction of a newspaper including a half-tone picture of 85 lines/25.4 mm was carried out on the hydrophilic layer of the plate A with a facsimile. The facsimile was operated at a maximum output voltage of 80 volts while scanning the plate with a needle electrode of 0.15 mm in diameter under conditions of a needle pressure of 10 g, a linear speed of 100 m/min and a line density of 10 lines/mm.

The planographic printing plate obtained was used to conduct an offset printing using water as wetting water. As a result, at least 50,000 clear copies were obtained with the half-tone picture being also clearly reproduced.

EXAMPLE 2

35 g of conductive carbon black "Corax L" was added to 400 g of resin solution A (the preparation of which will be described in detail hereinafter and dispersed therein, to which were further added 3 g of α,α-azobisisobutyronitrile and 4 g of benzophenone to obtain a composition for preparing a conductive oleophilic substrate. The composition was applied onto one surface of a 0.15 mm thick aluminum sheet and baked for curing at 110°-120° C. for 10 minutes to form a 10 μm thick layer on the sheet, thereby giving a conductive oleophilic substrate B. The resin layer had a volume resistivity of $3\times10^{3}$ ohm·cm.

Then, a solution of 40 g of 2-phosphoric ethylenemethacrylate in 60 g of methanol was coated onto the one surface of the substrate B. The thus coated layers having 4 μm in thickness of the substrate B was irradiated by actinic ray from a high pressure mercury lamp of 400 W at a distance of 5 cm from the layer for 2 minutes, followed by washing with a mixed solution of water and methanol in a ratio of 1:1 to obtain a plate B for planographic printing having a hydrophilic layer.

Thereafter, the plate B was subjected to a plate making procedure using a facsimile and then to offset printing in the same manner as in Example 1. The test results where similar to those of Example 1.

Preparation of Resin Solution A

A mixture of 25 parts (parts are by weight here and whenever it appears hereinafter) of toluene and 25 parts of methyl ethyl ketone (MEK) was placed into a reaction vessel. The mixture was heated and maintained at the boiling point, to which was dropwise added a mixture of 20 parts of n-butyl acrylate, 15 parts of methyl methacrylate, 15 parts of acrylic acid and 0.5 parts of α,α-azobisisobutyronitrile (AIBN) in the course of 100 minutes under a nitrogen gas atmosphere. The mixture was maintained at the temperature for further 100 minutes and then added with 5 parts of a 5 wt% AIBN solution in MEK and further polymerized for 60 minutes. Then, 25 parts of glycidyl methacrylate containing 0.1 parts of hydroquinone and 25 parts of a 20% tetraethylammonium bromide solution in methanol were added to the polymerized mixture to effect the additional reaction at 100° C. while contacting with air. After about 2 hours of the reaction, the acid value of the resin component reached to 70 and hence the reaction mixture was rapidly cooled to stop the reaction. Finally, an equimolar mixed solution of toluene and MEK was added to the reaction mixture to adjust the resin content to 25% by weight of the solution (solution A).

EXAMPLE 3

13 g of carbon black for coating purpose were dispersed into a solution of 50 g of an ABS resin (available under the trade name of "Kane Ace S-10" from Kanegafuchi Chem. Ind. Co.) in 450 g of toluene. The resultant composition was applied onto one surface of a polyester film metallized with aluminum and dried to evaporate the solvent to obtain a conductive oleophilic substrate C forming a 10 μm thick resin layer thereon. The ABS resin layer had a volume resistivity of about $2\times10^2$ ohm·cm. Then, a solution of 4 g of acetophenone and 94 g of N,N-dimethylacrylamide was applied onto the ABS resin layer surface of the substrate C. The thickness of the amide layer was about 3 μm. The thus applied substrate was irradiated with actinic ray from a high pressure mercury lamp of 400 W at a distance of 5 cm from the layer for 2 minutes, followed by washing with water to obtain a plate C for planographic printing having a hydrophilic layer.

The plate C was subjected to a plate making procedure using a facsimile and then to offset printing in the same manner as in Example 1, with the test results being similar to those of Example 1.

EXAMPLE 4

300 g of semiconductive zinc oxide doped with aluminum (1.0 mol% as aluminum) and 1 g of conductive carbon black "Corax L" (product of Deggusa Co., of West Germany), was added to 100 g of 1,4-polybutadiene ("LCB-150", product of Nippon Zeon Co., Ltd.) dissolved in 500 g of mineral spirits and sufficiently dispersed with paint conditioner. To the dispersion was added 0.1 g of cobalt naphthenate calculated as metallic cobalt to give a composition.

The composition was applied onto one surface of a 0.15 mm thick aluminum sheet in such a manner that a 10 μm thick film was obtained after drying. After removal of the solvent by evaporation, the applied composition was baked at 170°–180° C. for 15 minutes and almost hardened to give a conductive oleophilic substrate D. The polybutadiene layer had a volume resistivity of about 9 ohm·cm.

The substrate D was coated on the side of the polybutadiene layer with a solution which consisted 40 g of acrylamide, 2 g of benzophenone, 2 g of diethanolamine and 60 g of methanol, and dried for 20 minutes. The thickness of the acrylamide layer was about 2 μm. Thereafter, the acrylamide layer was irradiated for 5 minutes with actinic ray from a high pressure mercury lamp of 200 W at a distance of 5 cm from the layer and then washed with water to give a plate D for planographic printing having a hydrophilic layer. The reproduction of a newspaper including a half-tone picture of 85 lines/25.4 mm was carried out on the hydrophilic layer of the plate D with a facsimile. The facsimile was operated at a maximum output voltage of 80 volts while scanning the plate with a needle electrode of 0.15 mm in diameter under conditions of a needle pressure of 10 g, a linear speed of 100 m/min and a line density of 10 lines/mm.

The resulting planographic printing plate was used to conduct an offset printing using water as wetting water. As a result, at least 50,000 clear copies were obtained with the half-tone picture being also clearly reproduced.

EXAMPLE 5

In 400 g of the resin solution A as prepared in Example 2 were dispersed 500 g of semiconductive titanium dioxide (S-TC, product of Kyoritsu Yogyo Genzairyo Co.) and 2.0 g of conductive carbon black "Corax L", to which were further added 3 g of α,α-azobisisobutyronitrile and 4 g of benzophenone to give a composition for making a conductive oleophilic substrate. The composition was applied onto one surface of a 0.15 mm thick aluminum sheet and baked at 110°–120° C. for 10 minutes for curing. As a result, a 10μ thick layer was formed on the sheet to give a conductive oleophilic substrate E. The resin layer had a volume resistivity of $8\times10^{-2}$ ohm·cm.

Then, a solution of 40 g of 2-phosphoric ethylenemethacrylate in 60 g of methanol was coated onto the resin layer of the substrate E. The thickness of the methacrylate layer was about 4 μm. The methacrylate layer of the thus coated substrate was irradiated for 2 minutes with actinic ray from a high pressure mercury lamp of 400 W at a distance of 5 cm from the layer, followed by washing with a mixed solution of water and methanol in a mixing ratio of 1:1 to obtain a plate E for planographic printing having a hydrophilic layer on the surface.

The plate was subjected to a plate making procedure using a facsimile and then to offset printing in the same manner as in Example 4, with the results similar to those of Example 4.

EXAMPLE 6

In a solution of 50 g of an ABS resin ("Kane Ace" S-10 product of Kanegafuchi Chem. Ind. Co.) in 450 g of toluene were dispersed 350 g of semiconductive titanium dioxide S-TC and 1.5 g of carbon black for coating purpose. The resulting dispersion was applied onto one surface of a 75 μm thick polyester film metallized with aluminum and dried to evaporate the solvent. As a consequence, a 10 μm thick layer was formed on the film to obtain a conductive oleophilic substrate F. The ABS resin layer had a volume resistivity of about $2\times10^{-3}$ ohm·cm.

Then, a solution of 4 g of acetophenone and 94 g of N,N-dimethylacrylamide was applied onto the ABS resin layer surface of the substrate E. The thickness of the amide layer was about 3 μm. The amide layer of the thus applied substrate was irradiated for 2 minutes with actinic light from a high pressure mercury lamp of 200 W at a distance of 5 cm from the plate, following by washing with water to obtain a plate for planographic printing having a hydrophilic layer.

The plate F was subjected to a plate making procedure using a facsimile and then to offset printing in the same manner as in Example 4, with the results similar to those of Example 4.

EXAMPLE 7

2.6 g of conductive carbon black "Corax L" was added to 30 g of a solution of 30 wt % of Epikote 1004 (product of Shell Chem. Co.) in methyl ethyl ketone (MEK) and was sufficiently dispersed in a paint conditioner. To the dispersion was further added 18 g of a 5 wt % 2-ethyl-4-methylimidazole solution in methyl isobutyl ketone to obtain a composition. The methylimidazole was used as curing agent.

The composition was applied onto one surface of a 60 μm thick aluminum sheet. After removal of the solvent by evaporation, the applied composition was baked at 180° C. for 1 minute for curing, thereby obtaining a conductive oleophilic substrate G having a 12 μm thick oleophilic polymer layer. The oleophilic layer had a volume resistivity of $5\times10^{-2}$ ohm·cm.

Thereafter, a composition comprising 15 g of acrylamide, 37 g of glycerine, 0.7 g of benzophenone, 1,3 g of Emulgen 911 (polyethylene glycol alkylphenyl ether, product of Kao Atlas Co.), 7 g of methanol and 39 g of water was applied onto the surface of the oleophilic polymer layer of the substrate in such a manner as to ensure a coated amount or spread of 40 g/m$^2$. The thus applied substrate was then irradiated for 30 seconds with actinic ray from a high pressure mercury lamp of 2KW at a distance of 20 cm from the coated surface and then washed with water to obtain a plate for planographic printing including the substrate chemically combined with a hydrophilic layer (which had a contact angle of 7° with regard to water).

The reproduction of an original including a half-tone picture of 120 lines/25.4 mm was carried out the hydrophilic layer of the plate with a fascimile. That is, the facsimile plate was operated at an output voltage of 45 V while scanning the plate with a needle electrode of 0.15 mm in diameter under conditions of a needle pressure of 7 g, a line density of 16 lines/mm and a scanning speed of 2 m/minute. The resulting planographic printing plate was used to conduct an offset printing. As a result, at least 50,000 clear copies were obtained with the half-tone picture being also clearly reproduced.

Furthermore, the plate was irradiated with a laser beam to form a parallel straight line pattern on the hydrophilic layer by means of a laser beam of a wavelength of 6328 Å and an output power of 30 mW emitting from a He-Ne laser source. The laser beam was converged by use of lenses and the medium was placed in such a manner that the converged beam was applied vertically to the plate surface in a diameter of 50 μm. The plate was moved in vertical relation to the laser beam and at a rate of 5 cm/sec. The resulting plate was used to conduct an offset printing, from which it was found that at least 50,000 clear copies with a resolving power of 8 lines/mm were reproduced.

EXAMPLE 8

3.0 g of Corax L was added to 30 g of a solution of 30 wt % Epikote 1001 (product of Shell Chem. Co.) in MEK and sufficiently dispersed in a paint conditioner. To the dispersion were further added 4.5 g of a solution, in butyl acetate, of 50 wt % of a block isocyanate (having an effective NCO of 7.0%) obtained by blocking the trimer of tolylenediisocyanate with meta-cresol, and 16 g of methyl isobutyl ketone to obtain a composition.

The composition was applied onto a 60 μm thick polyester sheet metalized with aluminum and dried to evaporate the solvent, followed by baking at 180° C. for 30 seconds for curing to obtain a substrate H having a 10 μm thick oleophilic polymer layer. The layer had a volume resistivity of $2\times10^{-2}$ ohm·cm.

Then, a composition comprising 39 g of acryloyl morphorine, 20 g of polyethylene glycol (with a number average molecular weight of 2000), 1 g of acetophenone 1 g of benzoin ethyl ether, 10 g of methanol and 29 g of isopropyl alcohol was applied onto the surface of the oleophilic layer of the substrate in such a manner that its spread was 30 g/m$^2$. Thereafter, the thus applied surface was irradiated for 20 seconds with actinic light from a high pressure mercury lamp of 3 KW at a distance of 20 cm from the coated surface, and then washed with water to obtain a plate for planographic printing having a hydrophilic layer (having a contact angle of 8° with regard to water) on the surface.

The plate was subjected to a plate making procedure using a facsimile in the same manner as in Example 7, with the results similar to those of Example 7.

Furthermore, hydrophilic surface of the plate was irradiated with a laser beam to form a parallel straight line pattern on the hydrophilic layer by means of a laser beam of a wavelength of 4,880 Å and an output power of 280 mW. The laser beam was converged by use of lenses and the plate was placed in such a manner that the converged beam was applied vertically to the medium surface in a diameter of 2 μm. The medium was moved in vertical relation the laser beam and at a rate of 50 cm/sec. The resulting plate was used to conduct an offset printing, revealing that at least 50,000 clear copies with a resolving power of 22 lines/mm were reproduced.

EXAMPLE 9

5.0 g of Bersamide 400 (polyamide, product of General Mills Co.) was mixed with 25 g of semiconductive titanium dioxide (S-TC, product of Kyoritus Yogyo Genryo Co.) and 9 g of toluene for dispersion in a paint conditioner. To the dispersion was added 6 g of a solution of 50 wt % Epikote 1002 (product of Shell Chem. Co.) in MEK to obtain a composition. The composition was applied onto a 60 μm thick heat-resisting paper sheet metalized with aluminum and baked at 140° C. for 10 minutes for curing, thereby obtaining a substrate I having a 10 μm thick oleophilic layer. The oleophilic layer had a volume resistivity of $5\times10^{6}$ ohm·cm.

Then, onto the surface of the oleophilic layer of the substrate I was applied a composition comprising 10 g of NK ester M-23G (monomethoxypolyethylene glycol monomethacrylate having a number average molecular weight of 1068, product of Shin Nakamura Chem. Co.), 20 g of acrylamide, 25 g of glycerine, 0.3 g of Tylose H 10000 (hydroxyethyl cellulose, product of Hoechst A.G.), 1 g of benzophenone, 2 g of Emulgen 911, 10 g of methanol, 5 g of triethanolamine and 27 g of water in such a manner that a spread of the solution was 30 g/m$^2$. The thus applied substrate was then irradiated for 5 seconds with actinic ray from a high pressure mercury lamp of 6 KW at a distance of 20 cm from the surface of the plate and washed with water to obtain a plate for planographic printing having a hydrophilic layer (with a contact angle of 8° with regard to water).

The medium was subjected to a plate making procedure using a facsimile in the same manner as in Example 7, with the results similar to those of Example 7.

EXAMPLE 10

3 g of copper powder was added to 50 g of a solution of 20 wt % Ester Resin 200 (polyester produced by Toyo Boseki K.K.) in MEK and sufficiently dispersed with a paint conditioner. To the dispersion was added 0.29 g of Desmodur L-75 (75 wt % isocyanate solution in ethyl acetate, product of Bayer A.G.) to obtain a composition. The composition was applied onto a 100 μm thick zinc-galvanized iron sheet and dried to evaporate the solvent, followed by baking at 180° C. for 1 minute for curing to obtain a substrate having a 15 μm thick oleophilic polymer layer. The oleophilic layer had a volume resistivity of $8\times10$ ohm·cm.

The same composition as used in Example 7 was applied onto the surface of the oleophilic layer of the substrate in an amount of 20 g/m$^2$ and irradiated for 5 seconds with actinic ray from a high pressure mercury lamp of 6 KW at a distance of 20 cm from the coated surface, followed by washing with water to obtain a printing medium having a hydrophilic layer (with a contact angle of 7° with regard to water).

The medium was subjected to a plate making procedure using a facsimile in the same manner as in Example 7, with the results similar to those of Example 7.

EXAMPLE 11

2.6 g of Corax L was dispersed into 20 g of Acrydic A 801 (solution of 50 wt % acrylic polymer in toluene and butyl acetate, product of Japan Leichhold Co.) with a paint conditioner. To the dispersion was further added Desmodur L-75 in an amount of 4 g to give a composition.

The composition was applied onto a 100 μm thick copper plate and dried to evaporate the solvent, followed by baking at 180° C. for 15 minutes for curing to a substantial degree to obtain a substrate having a 10 μm thick oleophilic polymer layer. The layer had a volume resistivity of $2\times10^{-1}$ ohm.cm.

The same composition as used in Example 8 was applied onto the surface of the polymer layer of the substrate in an amount of 10 g/m$^2$ and irradiated for 3 seconds with actinic ray from a high pressure mercury lamp of 6 KW at a distance of 15 cm from the coated surface, followed by washing with water to obtain a printing plate having hydrophilic layer (with a contact angle of 6° for water).

The plate was subjected to a plate making procedure using a facsimile in the same manner as in Example 7, with the results similar to those of Example 7.

EXAMPLE 12

10 g of zinc powder was added to 30 g of a xylol solution of 60 wt % melamine-formaldehyde resin (the preparation of which will be described in detail hereinafter) and sufficiently dispersed with a paint conditioner, to which was added 7.2 g of a xylol solution of 50 wt % acrylic copolymer (the preparation of which will be described in detail hereinafter) to obtain a composition.

The composition was applied onto a 50 μm thick aluminum sheet and dried to evaporate the solvent, followed by baking at 160° C. for 2 minutes for curing to obtain a substrate having a 8 μm thick oleophilic polymer layer. The polymer layer had a volume resistivity of $8\times10^2$ ohm.cm.

The same composition as used in Example 9 was applied onto the surface of the oleophilic layer of the substrate in an amount of 10 g/m$^2$ and irradiated for 2 seconds with actinic ray from a high pressure mercury lamp of 6 KW at a distance of 15 cm from the applied surface, followed by washing with water to obtain a plate for planographic printing having a hydrophilic layer (with a contact angle of 7° for water).

The plate was subjected to a plate making procedure using a facsimile in the same manner as in Example 7, with the results similar to those of Example 7.

Preparation of Melamine-formaldehyde Resin 126 parts of melamine, 375 parts of butanol formaline and 265 parts of n-butanol were placed in a flask, which was gradually heated until the reaction system turned transparent. Thereafter, dehydration reaction was effected under refluxing conditions for 3 hours. The n-butanol and formed water were then removed by distillation first under a normal pressure for 1 hour and then under a reduced pressure, thereby obtaining a butyl-etherized melamine resin solution having a non-volatile matter of 70 wt %. The solution was added with xylol to lower the volatile matter down to 60 wt % and then filtered. The resulting filtrate was observed to be a transparent, viscous liquid a viscosity corresponding to U-V (at 25° C.) by the Gardner-Holdt bubble viscometer.

Preparation of Acrylic Copolymer 100 parts of xylene was introduced into a four neck flask equipped with an agitator, a reflux condenser, a nitrogenfeed tube and a thermometer, followed by heating to 120° C. in a stream of nitrogen with agitation. To the xylene was dropwise added by means of a dropping funnel within 2 hours, a mixture of 70 parts of n-butyl acrylate, 20 parts of 2-hydroxyethyl methacrylate, 10 parts of acrylic acid and 2 parts of α,α'-azobisisobutyronitrile. After completion of the dropping, the temperature was elevated to 130° C., at which the reaction system was maintained for 3 hours under agitation to obtain a solution of an acrylic resin having a number average molecular weight of 11,000 and a non-volatile matter of 49.5 wt %.

EXAMPLE 13

5.0 g of a n-butanol solution of 60 wt % phenolic resin (the preparation of which will particularly described hereinafter) was added with 18 g of semiconductive zinc oxide doped with aluminum (in an amount of 1.0 mol % calculated as aluminum oxide) and 9 g of toluene for sufficiently dispersing the zinc oxide by means of a paint conditioner. To the dispersion was further added 1.2 g of a solution, in xylol, of 49.5 wt % acrylic copolymer of the same type as used in Example 12 to obtain a composition.

The composition was applied onto a 90 μm thick aluminum sheet and dried to evaporate the solvent, followed by baking at 180° C. for 2 minutes for curing to obtain a substrate having thereon a 12 μm thick oleophilic polymer layer. The polymer had a volume resistivity of $3\times10^7$ ohm.cm. The same composition as used in Example 7 was applied onto the surface of the polymer layer of the substrate in an amount of 10 g/m$^2$, followed by irradiation with actinic ray from a high pressure mercury lamp of 6 KW for 2 seconds at a distance of 15 cm from the applied surface and washing with water to obtain a plate for planographic printing having thereon a hydrophilic layer (with a contact angle of 8° for water).

The plate was subjected to a plate making procedure using a fascimile in the same manner as in Example 1 with the results similar to those of Example 1.

Preparation of Phenolic Resin 280 parts of paraform (having an effective amount or purity of 85%) and 888 parts of n-butanol were placed in a flask and was heated up to 70° C., to which was added a small amount of dimethylaminoethanol. The reaction mixture was agitated until it turned transparent. Thereafter, 188 parts of phenol was added to the system, which was then added with acetic acid to adjust pH to 4–6. A dehydration reaction was carried out under reflux for about 3 hours. Then, the solvent was removed by distillation until the reaction product was condensed to have a concentration of 70 wt %, to which was added n-butanol to dilute the solution to 60 wt %. The resulting product was found to have a viscosity corresponding to H-I by the Gardener-Holdt bubble viscometer at 25° C.

EXAMPLE 14

A solution of 4 g of benzophenone and 94 g of N,N-dimethylacryl amide was applied onto the ABS resin layer surface of the same substrate C as in Example 3. The thickness of the amide layer was about 3 μm. The thus applied substrate was heated at 80° C. for 1 hour without volatilization of the amide layer, followed by washing with water to obtain a plate for planographic printing having a hydrophilic layer. Then, the printing plate was produced in the same manner as in Example 1.

The resulting planographic printing plate was used to conduct an offset printing using city water as wetting water. As a result, at least 5,000 clear copies were obtained with the half-tone picture being also clearly reproduced.

What is claimed is:

1. A method for producing a plate or sheet useful in oil base ink planographic printing which comprises providing a substrate of an oleophilic resin having in the molecules thereof carbon-carbon double bonds and/or carbon atoms bonded with a single hydrogen atom in a total amount of not less than 0.05 mol/kg and having a contact angle with pure water above 40 degrees, non-mixingly contacting the substrate with hydrophilic radical polymerizable compound, wherein said hydrophilic radical polymerizable compound is a monomer capable of being dissolved in water or hydrophilic organic solvents or swollen by absorbing the water or the solvents in an amount of above 10% by weight at room temperature when converted to a homopolymer, and exposing the substrate contacted with the compound to actinic ray of 250 nm to 700 nm wavelength to form a hydrophilic thin layer chemically combined with the substrate, said thin layer having a contact angle with pure water of 20 degrees or less.

2. A method as claimed in claim 1, wherein said oleophilic resin is a member selected from the group consisting of diene homopolymers, diene copolymers, homo- or copolymers of 1-substituted olefins, copolymers of 1-substituted olefins with 1,2-di-substituted olefins, copolymers of 1-substituted olefins and/or 1,2-di-substituted olefins with 1,1-di-substituted olefins, unsaturated polyesters, unsaturated polyepoxides, unsaturated polyamides, unsaturated polyacryls epoxy resins, phenolic resins etherized with glycidyl ether, phenolic resins, polyurethanes, amino resins, polycarbonates, polyethers, furan resins, and polysulfons.

3. A method as claimed in claim 1, wherein and substrate contains conductive or semiconductive powder uniformly dispersed in said oleophilic resin to have a volume resistivity of from $10^{-3}$ to $10^8$ ohm.cm.

4. A method as claimed in claim 3, wherein said conductive or semiconductive powder is a member selected from the group consisting of carbonaceous materials, metals and semiconductive metal compounds doped with impurity element.

5. A method as claimed in claim 1, wherein said hydrophilic radical polymerizable compound is a member selected from the group consisting of acrylic acid, methacrylic acid, acrylic esters, methacrylic esters, vinyl compounds, styrene sulfonic acids, maleic acids, maleimides, acrylamides, and methacrylamides.

6. A method as claimed in claim 1, wherein said hydrophilic radical polymerizable compound is contacted with said substrate in the form of a composition which comprises at least 4% by weight of said compound, up to 10% by weight of a photosensitizer, up to 50% by weight of other radical polymerizable compound and up to 90% by weight of a solvent.

7. A method as claimed in claim 1, wherein said substrate further includes a support.

8. A method as claimed in claim 7, wherein said support is a member selected from the group consisting of paper, plastic and metal.

9. A method as claimed in claim 7, wherein said support includes a conductive layer in contact with said substrate to ensure passage of electric current to said substrate through said conductive layer.

10. A method as claimed in claim 1, further comprising treating said substrate obtained after completion of the irradiation with a non-solvent incapable of dissolving said substrate to remove the hydrophilic radical polymerizable compound remaining unreacted and a polymer formed from said compound but remaining chemically uncombined with said substrate.

11. A method as claimed in claim 1, wherein said substrate has carbon-carbon double bonds and/or carbon atoms bonded with a single hydrogen atom in a total amount of not less than 0.1 mol/kg and a contact angle with pure water above 50 degrees.

12. A method as claimed in claim 4, wherein said substrate further includes an aluminum sheet support, said oleophilic resin is polybutadiene containing carbon black and wherein said hydrophilic radical polymerizable compound is acrylamide.

* * * * *